US006869409B2

(12) United States Patent
Rothman et al.

(10) Patent No.: US 6,869,409 B2
(45) Date of Patent: Mar. 22, 2005

(54) BELT WITH DETACHABLE BLADDER FOR CARDIOPULMONARY RESUSCITATION AND CIRCULATORY ASSIST

(75) Inventors: Neil S. Rothman, Baltimore, MD (US); Mark Gelfand, Baltimore, MD (US)

(73) Assignee: Revivant Corporation, Sunnyvale, CA (US)

( * ) Notice: Subject to any disclaimer, the term of this patent is extended or adjusted under 35 U.S.C. 154(b) by 0 days.

(21) Appl. No.: 09/062,714

(22) Filed: Apr. 20, 1998

(65) Prior Publication Data

US 2002/0007132 A1 Jan. 17, 2002

Related U.S. Application Data

(63) Continuation-in-part of application No. 08/404,442, filed on Mar. 15, 1995, now Pat. No. 5,769,800.

(51) Int. Cl.[7] ..... A61H 31/00
(52) U.S. Cl. ..... 601/44; 601/152
(58) Field of Search ..... 601/41, 43, 44, 601/150, 151, 106, 148, 149, 152, 153

(56) References Cited

U.S. PATENT DOCUMENTS 2,699,163 A * 1/1955 Engstrom ..... 601/44
2,762,366 A 9/1956 Huxley III et al.
2,899,955 A * 8/1959 Huxley, III et al. ..... 601/44
4,083,070 A * 4/1978 Martin ..... 441/40
4,349,015 A 9/1982 Alferness
4,355,632 A * 10/1982 Sandman ..... 601/152
4,424,806 A 1/1984 Newman et al.
4,664,098 A 5/1987 Woudenberg et al.
4,682,588 A * 7/1987 Curlee ..... 128/DIG. 20
4,770,164 A 9/1988 Lach et al.
4,838,263 A 6/1989 Warwick et al.
4,840,167 A 6/1989 Olsson et al.
4,928,674 A 5/1990 Halperin et al.
5,076,256 A 12/1991 Raymer et al.
5,222,478 A 6/1993 Scarberry et al.
5,361,418 A 11/1994 Luzenske
5,490,820 A 2/1996 Schock et al.

* cited by examiner

*Primary Examiner*—Danton DeMille
(74) *Attorney, Agent, or Firm*—K. David Crockett, Esq.; Crockett & Crockett

(57) ABSTRACT

An inflatable vest design for cardiopulmonary resuscitation (CPR) and for cardiac assist. The vest may include a belt that wraps around the chest of a patient, and a removable bladder that is placed against the chest and held in place by the belt. The inflatable bladder expands radially to first conform to a patient's chest, and to apply circumferential pressure to the thorax of the patient. By cyclically inflating the bladder, the vest can be used in CPR and cardiac assist treatments. In addition, alternative vest designs are disclosed showing removable bladders. These vest improvements lower the energy consumption and make smaller and portable cardiopulmonary resuscitation systems more practical.

10 Claims, 6 Drawing Sheets

BELT WITH DETACHABLE BLADDER FOR CARDIOPULMONARY RESUSCITATION AND CIRCULATORY ASSIST

RELATED APPLICATION

This is a continuation-in-part application claiming priority to U.S. patent application Ser. No. 08/404,442, filed Mar. 15, 1995, and issued as U.S. Pat. No. 5,769,800 on Jun. 23, 1998.

FIELD OF THE INVENTION

The present invention relates to cardiopulmonary resuscitation (CPR) and circulatory assist systems, and in particular to an improved inflatable vest for those systems that is easy to apply to patients and reduces the energy consumed during inflation.

DESCRIPTION OF THE PRIOR ART

Cardiac arrest is generally due to ventricular fibrillation, which causes the heart to stop pumping blood. The standard treatment of ventricular fibrillation is defibrillation. Defibrillation applies an electrical shock to restart the heart, but does not by itself cause oxygenated blood to flow through the heart or the venous system of the patient. If more than a few minutes have lapsed since the onset of ventricular fibrillation, the heart will be sufficiently deprived of oxygen and nutrients such that defibrillation will generally be unsuccessful. Accordingly, it is necessary to restore the flow of oxygenated blood to the heart muscle by cardiopulmonary resuscitation in order for defibrillation to be successful.

Cardiac assist treatments augment the heart and the vascular system in moving blood through the heart, lungs and other organs. Cardiac assist aids a weakened heart that is still beating and moving blood in the venous system of the patient. In both cardiac assist and CPR, an inflatable vest can be used to cyclically compress the chest to raise intrathoracic pressure and move blood through the heart and other organs.

U.S. Pat. No. 4,928,674 captioned "Cardiopulmonary Resuscitation and Assisted Circulation System" (the '674 patent) describes a method of cardiopulmonary resuscitation using an inflatable vest operating under a pneumatic control system to apply circumferential pressure around a patient's chest. The '674 patent discloses a vest having a rigid base and one or more inflatable bladders. The present invention is an improved vest over that shown in the '674 patent that can be easily applied to a patient. In addition, the present invention requires less compressed air and consumes less energy than the vest shown in the '674 patent. Reducing the energy required for vest inflation is especially important for portable CPR and cardiopulmonary assist systems.

SUMMARY OF THE INVENTION

The present invention is an improved inflatable vest designed to be used is in cardiopulmonary resuscitation (CPR) and circulatory assist systems. The vest overcomes deficiencies in prior art designs. The vest is easily applied to a patient in an emergency situation, such as when a patient is suffering from cardiac arrest or some other acute heart ailment. The vest includes a radially expandable bladder held tightly against the chest. The bladder first expands to conform to a patient's dimensions, and then cyclically applies circumferential pressure to a patient's chest to sufficiently increase intrathoracic pressure to move blood through the heart and other organs. The vest bladder (either integral or removable) expands radially when filled with compressed air to conform to the patient's chest dimensions regardless of how tightly or loosely the vest is initially wrapped around the patient.

In addition, the vest minimizes the amount of compressed air needed in the compression/decompression cycle, by conserving the air pressure in the vest initially used to tighten the vest around a patient. The decrease in vest pressure during the compression/decompression cycle is sufficient to relieve the intrathoracic pressure in the chest of the patient and, during some cycles, sufficient to allow the patient to be ventilated, i.e., breath. Conserving some air pressure in the vest reduces energy consumption and makes a portable vest system more practical.

The vest is designed to work equally well whether it is applied tightly or loosely to the chest of a patient. The vest slips under a patient laying on his back, and wraps around the patient's chest. Velcro® strips on the vest hold the ends of the vest together around a patient's chest without the need for complicated hooks or locks.

The vest can have a detachable bladder. The vest may include a reusable belt that wraps around a patient, and a detachable bladder that is sandwiched between the belt and the chest of the patient. The bladder must be attached to the belt when the vest is used for CPR or for cardiopulmonary assist. The attachment between the belt and bladder may be temporary. The bladder may be detachable from the belt and discarded after it has been used on a patient. The bladder may include a temporary attachment mechanism, such as Velcro® strips that latch to strips on the belt or a sleeve that loops around the belt. The bladder may also be attached by simply being placed between the belt and the chest of the patient, such that the inflation of the bladder secures it to the belt.

DETAILED DESCRIPTION OF THE DRAWINGS

Figure 1A:
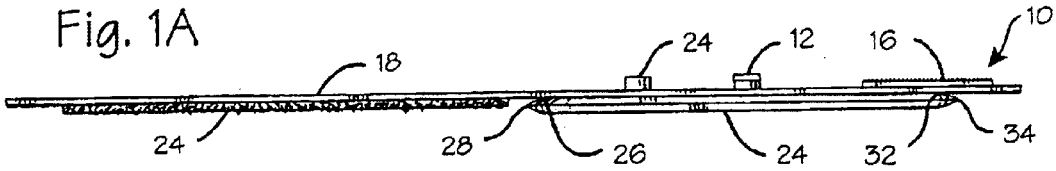
FIGS. 1A to 1C show side, top and bottom views of a first inflatable vest for CPR and cardiac assist.
Figure 1B:
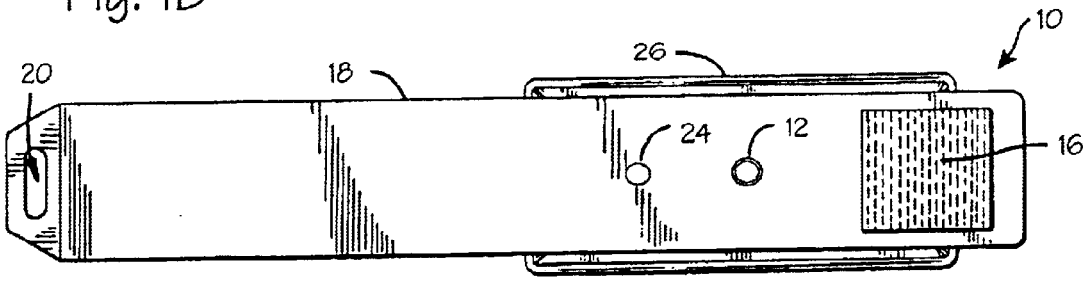
Figure 1C:
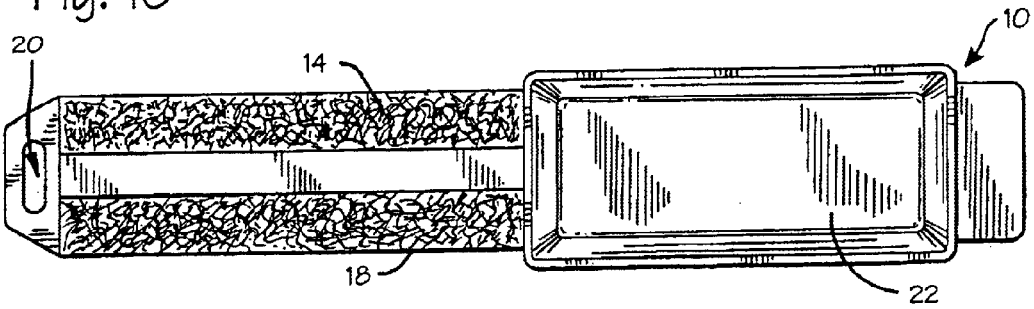

The details of a first embodiment of a vest in accordance with the present invention, are shown in FIGS. 1A, 1B, and 1C. The vest 10 is coupled by connector 12 to a hose 28 (FIG. 3) through which air flows from an air source 40 (FIG. 3) for controlled inflation and deflation of the vest bladder 22. The vest 10 is designed to fit around a patient's chest (see FIG. 3). Velcro® strips 14 and 16 secure the vest around the patient.

The vest 10 comprises a belt 18, a handle 20, a radially expandable bladder 22, and, optionally, a pressure safety relief valve 24. The belt 18 can be made from polyester double coated with polyurethane. The integral pressure relief valve 24 provides additional protection against over inflation of the vest, and will allow air to escape from the bladder if the pressure in the bladder exceeds a threshold value to which the valve 24 is set. However, the pressure relief valve may not be necessary, especially if the inflation system 40 has a mechanism to prevent excessive pressure in the bladder.

Then handle 20 is used to assist the operator in applying the vest 10 around the patient. In operation, the patient would be normally on his back and would be rotated to his side as the vest is placed under his back. In one technique for applying the vest, the vest handle 20 would be pushed under the patient and the patient rotated from his side to his back. The handle 20 would than be used to pull the vest under the patient to align the bladder with the chest of the patient. The portion of the vest remaining on the patient's other side would be wrapped around the chest, with the Velcro® strips 16 positioned to engage the Velcro® strip 14 adjacent to the handle 20. With the vest secured around the patient's chest, the bladder 22 can be initially inflated in a controlled manner to tighten the belt around the patient. Subsequently, the vest is cyclically inflated and partially deflated to provide the circumferential compression of the chest to move oxygenated blood through the heart, brain, the vascular system and other organs.

The vest design is insensitive to how tightly the vest is applied to the patient. The bladder of the vest and the rather-long length of the vest compensates for different patient dimensions. The bladder 22 is designed to apply a preset pressure to the patient's chest regardless of how tightly or loosely the vest belt is initially applied. Bladder 22 is made from two flat pieces of a nylon fabric double coated with polyurethane and connected along seams 26, 28, and 32, 34. This design geometry, and similar designs using multiple panels, allows the bladder to extend radially (like a bellows) towards and against the chest when inflated. The design geometry greatly restricts the sideward or outward expansion of the bladder which is namely ballooning of the bladder. Accordingly, the expansion of the bladder is primarily directed against the chest to increase therapeutic intrathoracic compression, and is not misdirected to balloon the bladder.

Figure 2A:
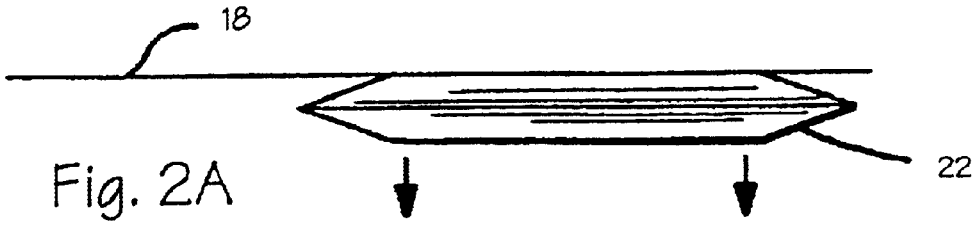
FIGS. 2A–2C are schematic drawings showing the radial expansion of the bladder of the vest shown in FIGS. 1A–1C, where the bladder tightens the vest around a patient's chest and compensates for any initial looseness of the vest around the chest.
Figure 2B:
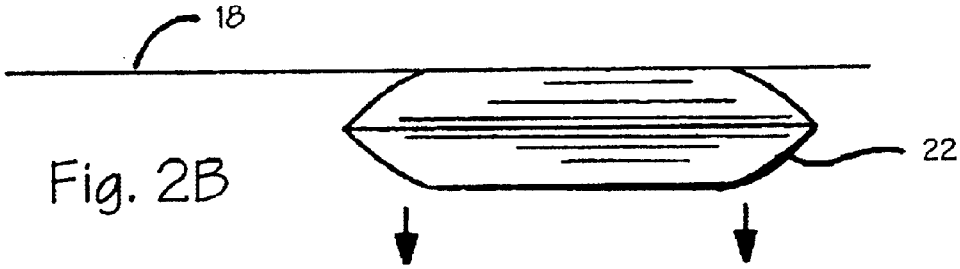
Figure 2C:
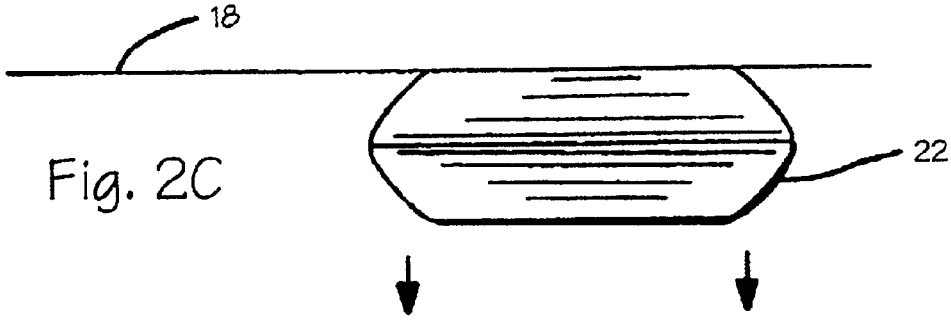

Radial expansion of the bladder is achieved by using an inextensible material for the bladder, that has no significant ballooning when inflated, and a bladder geometry that permits extension in one direction which is radially inward towards the chest. This radial expansion is shown in FIGS. 2A, 2B, and 2C. When the bladder is inflated, it expands radially to make contact with the patient's chest. Whether the belt 18 is attached loosely or tightly around the patient's chest, the bladder is designed to radially expand to contact the chest and tighten the vest. After contacting the chest, the bladder can be further pressurized to apply consistent circumferential compression to the chest.

Figure 3:
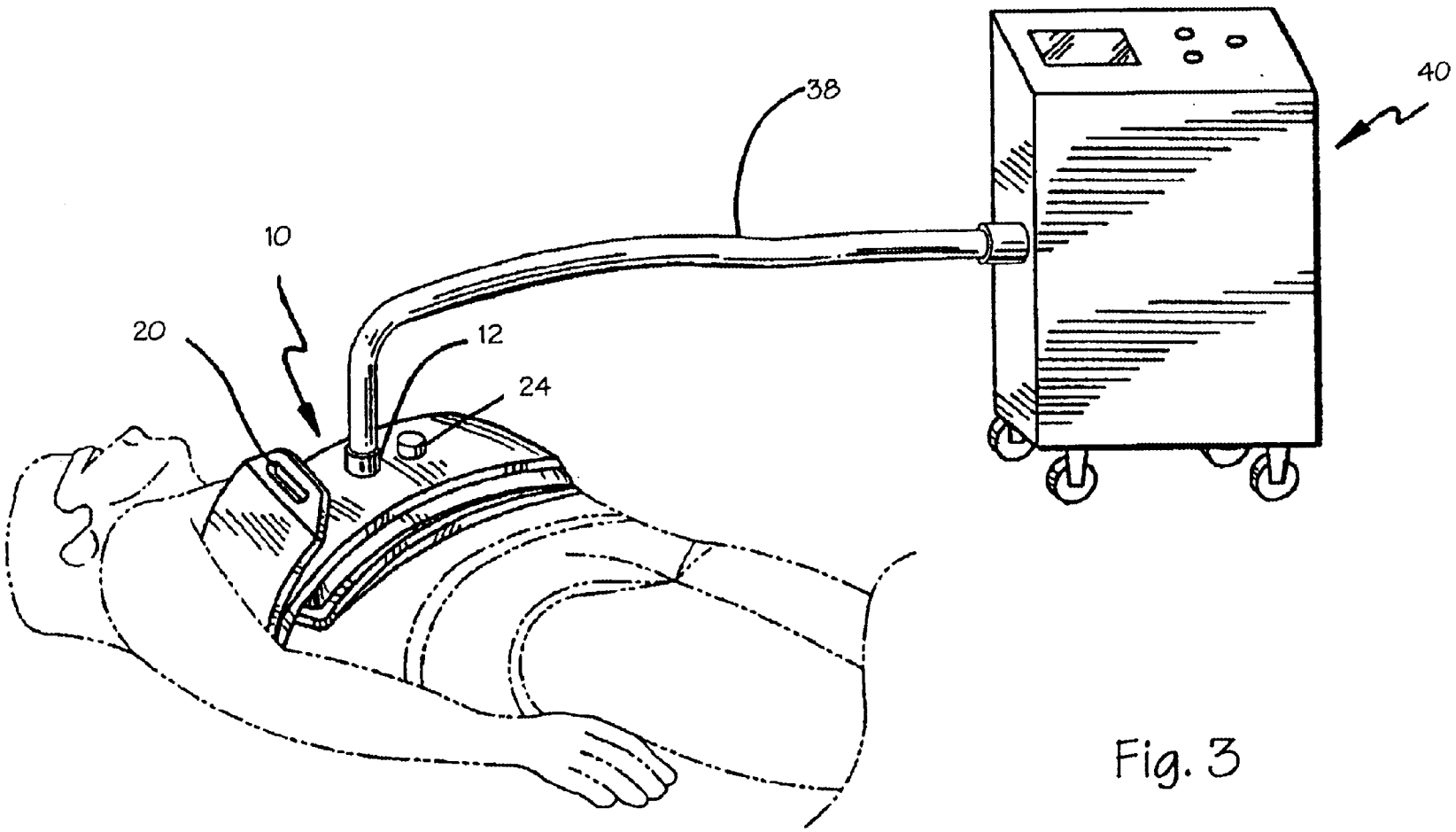
FIG. 3 is a schematic drawing of a CPR and cardiac assist system, including the vest shown in FIGS. 1A–1C applied to a patient.

FIG. 3 is a schematic diagram showing the vest 10 as part of the overall cardiopulmonary resuscitation and cardiac assist system. Female connector 12 on the vest 10 connects to a hose 38 to the pneumatic control system 40. Control systems are shown in pending U.S. patent application Ser. No. 08/731,049 entitled "Cardiopulmonary Resuscitation System With Centrifugal Compression Pump" and in the '674 patent. The vest should be positioned around the chest as shown in FIG. 3.

Figure 4:
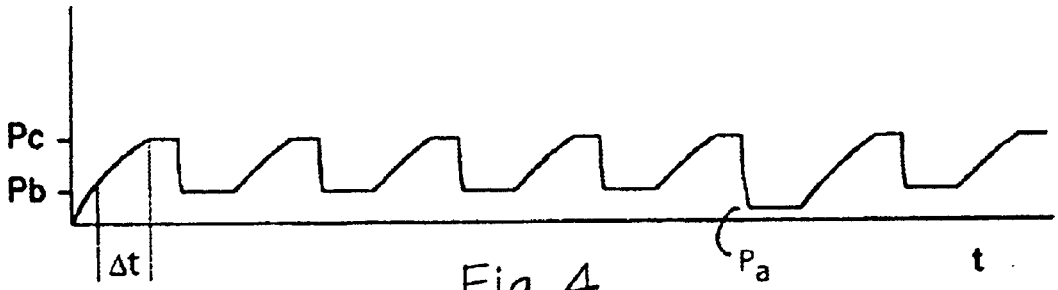
FIG. 4 is a graph of a pressure curve in the vest shown in FIGS. 1A–1C during the inflation/deflation cycles of the bladder.

The pneumatic control system 40 inflates and deflates the bladder 22 to achieve a particular cycle of chest compression and release. As shown in FIG. 4, the bladder is inflated to apply a certain circumferential pressure to the chest (Pc); and the bladder is then deflated in a controlled manner to a second lower bias pressure (Pb), which may be atmospheric pressure. This cycle is repeated a predetermined number of times. After a set number of cycles, e.g., five, the bladder pressure in the next cycle is decreased further to ambient pressure (Pa) to allow for ventilation of the patient. These cycles are repeated as long as the treatment is applied to the patient.

Figure 5A:
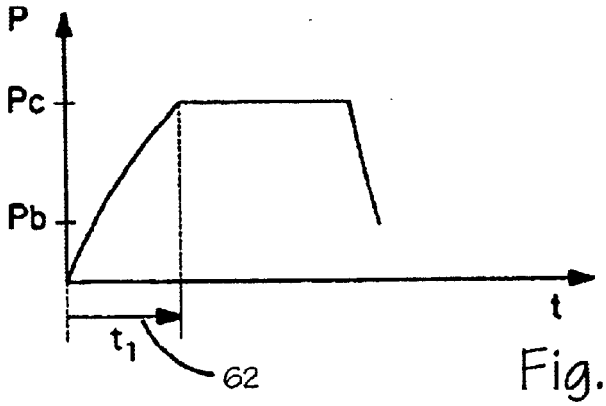
FIGS. 5A–5B is a graph of the pressure curve in the vest when the vest is either tightly applied 10 (FIG. 5A) or loosely applied (FIG. 5B).
Figure 5B:
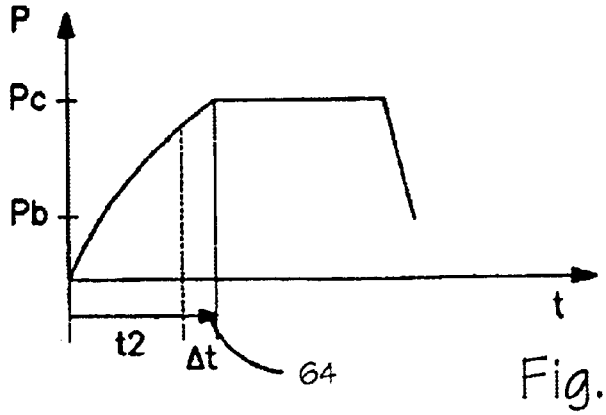

FIGS. 5A and 5B are graphs showing bladder pressure that show how the vest will expand to conform with the chest, and is further pressurized to apply pressure until the compression pressure (Pc) is reached. In FIG. 5A the vest is tightly applied around the patient's chest, and in FIG. 5B the vest is loosely applied to the patient. In both situations the vest bladder will expand radially to contact the chest and tighten the belt, and will then continue to apply pressure until the desired compression pressure (Pc) is applied to increase the intrathoracic pressure. When the vest is loosely applied, the amount of air required to tighten a loose vest (FIG. 5B) is greater than is needed for a belt that is applied tightly. As a result, the time to reach the compression pressure (Pc) will be slightly greater (Δ±) when the belt is applied loosely. The difference between $t_1$ (62) in FIG. 5A and $t_2$ (64) in FIG. 5B illustrates the extra time (Δ±) needed to tighten a loose vest. This extra (Δ±) period of time is not considered to be significant in the operation of the vest. Accordingly, there is no need for a tight application of the vest around the patient's chest. Because there is no precise requirement as to the applied vest tightness, the vest can be applied in the hectic situation of responding to a patient's emergency needs, without having the application of the vest be an undue concern to the physician team.

Figure 6A:
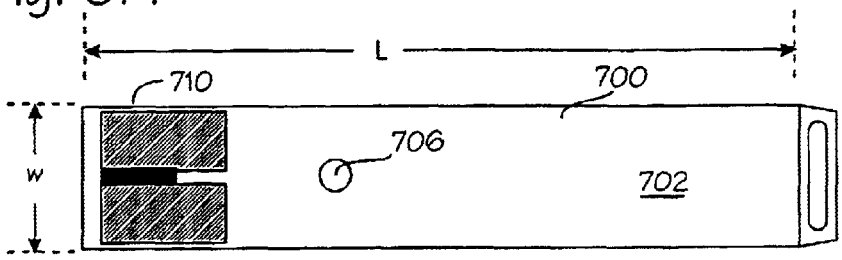
FIGS. 6A–6B are schematic diagrams of a belt for an alternative vest, where the bladder is detached from the belt.
Figure 6B:
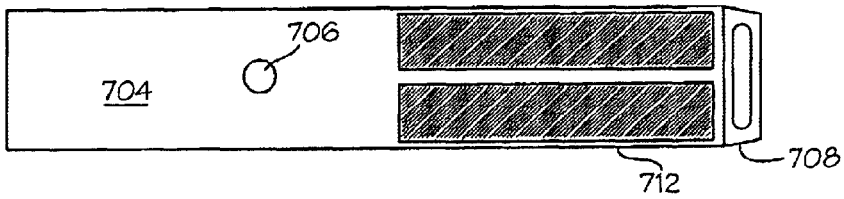
Figure 7:
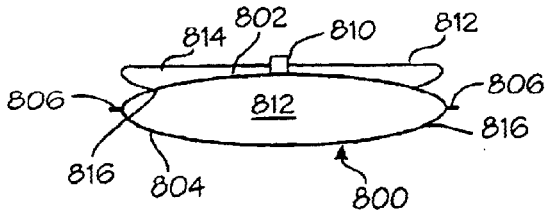
FIG. 7 is a cross-sectional schematic diagram of a detachable bladder to be used with the belt shown in FIGS. 6A and 6B.

FIGS. 6A–6B show an alternative vest comprised of a belt 700 to be used with a detachable bladder (see FIG. 7). FIG. 6A shows a top side 702 of the belt and FIG. 6B shows a bottom side 704 of the belt. The belt is a strip of inelastic material, such as polyester double coated with polyurethane. The belt includes an aperture opening 706 to receive a connector 810 of the bladder 800. In the belt has a handle 708, and Velcro® strips 710, 712 on opposite sides and ends of the belt. The arrangement of the Velcro® strips shown in FIGS. 7A and 7B is exemplary, and other arrangements of Velcro® strips or other attachment mechanisms may be used to secure the belt 700 around a patient.

The width (w) of the belt corresponds to the length of the thorax of a person, and may be 10 inches in wide. The width of the belt should preferably not be so width as to constrain the expansion of the abdomen of small adults. If the belt is to be used for children, then its width should not be so wide as to constrain the expansion of the abdomen of the children for which the vest is intended. The length of the belt should be sufficient to wrap around large adults. The belt may be, for example, 58 inches in length. A long belt with extended Velcro® strips can be easily applied to small persons, because the belt applied to a small person will have an extended free end which should not interfere with treating the patient.

FIG. 7 shows in cross-section a detachable bladder 800 to be used with the belt shown in FIGS. 6A and 6B. An advantage of a detachable bladder is to allow the belt to be reused. The detachable bladder may be discarded after a one time use on a patient. There may be circumstances in which an vest formed of an integral belt and bladder is reusable, and there is no need to detach the bladder. However, if it is desired that the bladder be discarded after use, then the detachable bladder 800 allows the belt 700 to be reused.

The detachable bladder 800 may be formed from a top rectangular section of fabric 802 and a bottom rectangular section of fabric 804 that are sealed together at a rectangular seam 806. The top and bottom fabric sections 802, 804 may be a nylon fabric double coated with polyurethane, or other strong and substantially inelastic fabric material. The shape of the fabric sections 802, 804 that form the bladder may have curved comers and may in other ways have a shape that is not rectangular.

The top (belt side) and bottom (chest side) sections 802, 804 of the bladder are sealed 806 at their edges to form an air-tight chamber 808. A connector port 810 provides an air passageway to the chamber of the bladder. The connector port may be a cylindrical post that forms a male connector to a hose (shown in FIG. 3). The connector port is shown at the center of the top fabric section 802, but may be located at some other position on the bladder. However, the top, center location for the connector has the advantage of allowing the connector port 810 to function as an alignment post to center the bladder 800 under the belt 700.

Figure 8:
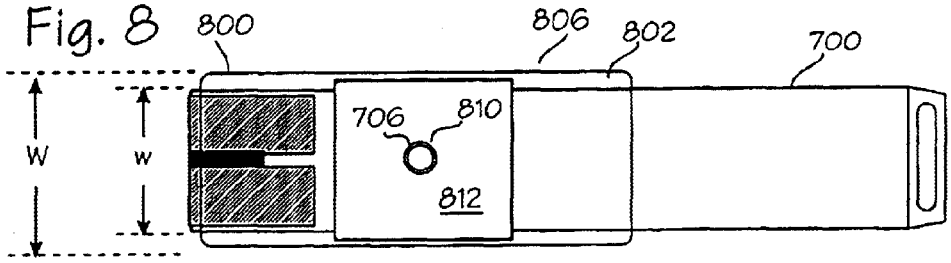
FIG. 8 is a schematic diagram of the alternative vest design having the belt shown in FIGS. 6A and 6B and the detachable bladder shown in FIG. 7.

As is shown in FIG. 8, the width (W) of the bladder 800 is greater than the width (w) of the belt 700. For example the bladder may be approximately two inches wider than the belt such that the bladder extends beyond the belt by one inch on both sides of the belt. The section of the bladder that extends beyond the width of the belt provides for the radial expansion (like a bellows) of the bladder. The design geometry and inelastic bladder material restrict the sideward or outward expansion of the bladder which is namely ballooning of the bladder. When assembled with the belt, the bladder is constrained on its top by the belt and on its bottom by the patient's chest. As the bladder inflates, the edges of the bladder (which includes the section of the bladder extending beyond the belt) expand radially, as would a pleat of a bellows. This expansion is almost completely radially inward toward the chest, once the belt is tight around the patient. The expansion of the bladder edges is not by way of stretching the inelastic bladder matter or in directions other than radially due to the design of the bladder and the constraints of the belt and chest. Accordingly, the expansion of the bladder is primarily directed against the chest where it increases intrathoracic compression.

The belt 700 has an aperture 706 through which extends the connector port when the bladder is coupled to the belt. The shape and area of the aperture 706 should be approximately the same as or slightly greater than the cross-sectional shape and area of the connector port 810 so that the connector port may easily inserted into the aperture, and to align the bladder under the belt.

A sleeve 812 on the bladder provides an opening 814 through which the belt extends in a manner similar to a belt in a belt loop. The sleeve may be formed of the same material as used for the bladder sections 802, 804, or may be of some other fabric. The sleeve is attached at its side edges 816 to the top section 802 of the bladder. The sleeve edges 816 are attached to the top bladder section inwardly of the bladder seam 806.

As is shown in FIG. 8, the belt 700 slides through the opening 814 between the sleeve 812 and the top section 802 of the bladder 800. The sleeve holds the bladder and belt together, and prevents the bladder from rotating beneath the belt. The belt slides through the sleeve, until the aperture 706 of the belt and the connector port 810 of the bladder align. The connector port is inserted through the aperture 706 to complete the assembly of the vest, and to prevent sliding of the bladder under the belt. Upon being assembled, the vest is ready to be wrapped around a patient. It may be preferable for a small number of belts and bladders to be assembled prior to any emergency. These assembled vests would be on-hand and ready for instant use in case of an emergency.

Figure 9:
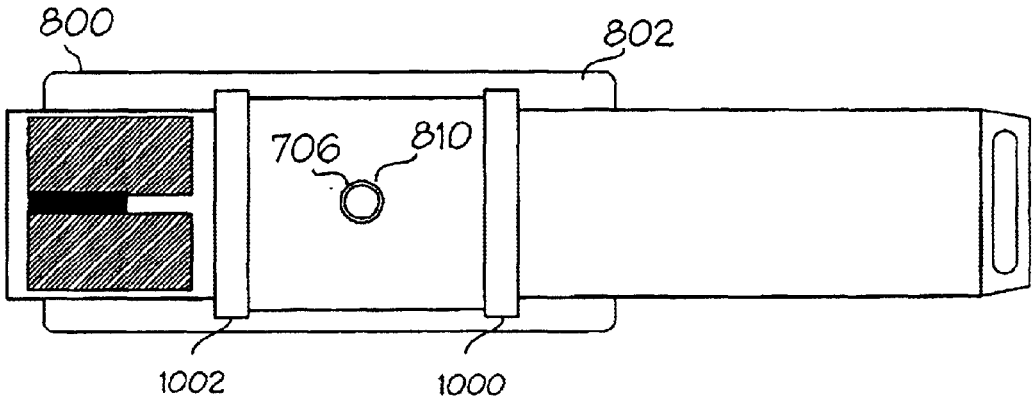
FIG. 9 is a schematic diagram of another alternative embodiment of a vest comprising a vest and a detachable bladder configuration.

FIG. 9 shows an alternative arrangement for securing a detachable bladder 800 to a belt 700. Instead of the sleeve 812 shown in FIG. 8, a plurality, e.g., a pair, of loops 1000, 1002 can be attached to the bladder to receive the belt. Each loop 1000, 1002 is attached at its ends to the top section 802 of the bladder. The loops are parallel to each other, and each loop forms an opening with the bladder to receive the belt 700. The loops prevent the bladder from rotating beneath the belt, while the aperture 810 and connector post 706 prevent the belt from sliding off the bladder.

Figure 10:
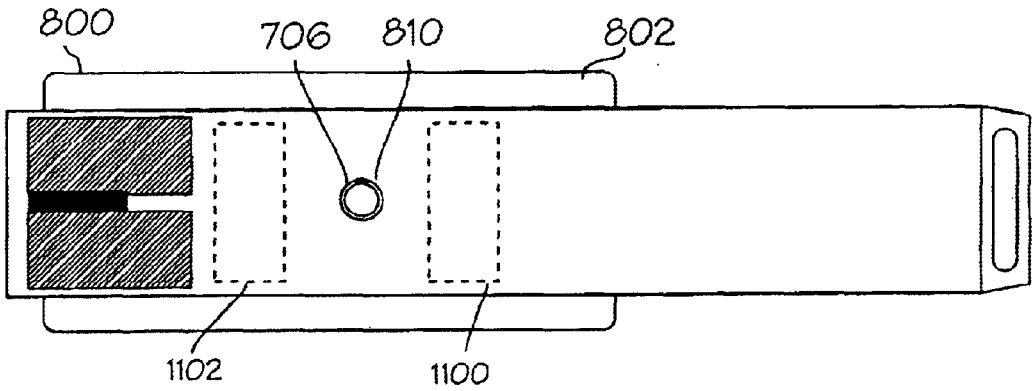
FIG. 10 is a schematic diagram of a further alternative embodiment of a vest comprising a vest and detachable bladder.

FIG. 10 shows a further arrangement for securing the bladder to the belt. A pair of adhesive strips, anti-skid pads, or Velcro™ patches 1100, 1102 may be affixed to the inner surface of the belt, and corresponding patches may be included on the top section 802 of the bladder. The bladder is attached to the belt by inserting the connector post 810 of the bladder through the aperture 706 of the belt, and then superimposing the patches 1100, 1102 on the belt over the corresponding patches on the bladder. It is preferred that the patches 1100, 1102 on the belt do not extend to the sides of the belt, but rather be positioned sufficiently inward on the belt to avoid interference with the expansion of the bladder.

Obviously, many modifications and variations of the present invention are possible in light of the above teachings. It is therefore to be understood that within the scope of the appended claims, the invention may be practiced otherwise than as specifically described.

What is claimed is:

1. An inflatable vest for administering CPR to a patient, the patient having a chest, armpits, and a sternum, said sternum having a superior-inferior length and said chest having an anterior surface, the inflatable vest comprising:

a belt sized to circumferentially fit around the patient and to cover substantially the entire width of the chest between the armpits and to cover substantially the entire superior-inferior length of the sternum, said belt being substantially circumferentially inextensible when fitted around the patient; and, a bladder attached to the belt, said bladder having a width and said bladder comprising:

a bottoms-chest panel composed of an inextensible material that is adapted to cover at least substantially the entire portion of the anterior surface of the chest of the patient;

a top-belt panel composed of an inextensible material and sealed to the bottom-chest panel to form a gas tight bladder chamber having an opening to receive compressed gas;

wherein the bottom-chest panel and the top-belt panel form a radially extensible bellows; and wherein the width of said bladder is at least two inches greater than the width of the belt.

2. An inflatable vest for administering CPR to a patient, the patient having a chest, armpits, and a sternum, said sternum having a superior-inferior length, the vest comprising:

a belt sized to circumferentially fit around the patient and to cover substantially the entire width of the chest between the armpits and to cover substantially the entire superior-inferior length of the sternum, said belt being substantially circumferentially inelastic when fitted around the patient; and a bladder, attached to the belt, said bladder having a width, said bladder comprising:

a bottom-chest panel composed of an inelastic material that is adapted to cover at least substantially the entire portion of the top of the chest of the patient; and a top-belt panel composed of an inelastic material and sealed to said bottom-chest panel to form a gas tight bladder chamber having an opening to receive compressed gas:

wherein the bottom-chest panel and the top-belt panel form a radially inelastically extensible bellows; and wherein the width of said bladder is at least two inches greater than the width of the belt.

3. An inflatable vest for administering CPR to a patient, the patient having a thorax, the vest comprising:

a belt sized to circumferentially fit around the patient, said belt having a width to cover substantially the entire thorax of the patient, said belt being substantially circumferentially inextensible when fitted around the patient; and a bladder, attached to the belt, said bladder having a width greater than the width of the belt, said bladder comprising:

a bottom-chest panel composed of an inextensible material that is adapted to cover substantially the entire thorax of the patient;

a top-belt panel composed of an inextensible material and sealed to said bottom-cheat panel to form a gas tight bladder chamber having an opening to receive compressed gas;

wherein the bottom-chest panel and the top-belt panel form a radially extensible bellows.

4. The vest of claim 3, wherein the width of said belt is about ten inches.

5. The vest of claim 3, wherein the width of said bladder is at least two inches greater than the width of the belt.

6. An inflatable vest for administering CPR to a patient, the patient having a chest, armpits, and a sternum, said sternum having a superior-inferior length, said vest comprising:

a belt sized to circumferentially fit around the patient and to cover substantially the entire width of the chest between the armpits and to cover substantially the entire superior-inferior length of the sternum, said belt being substantially circumferentially inextensible when fitted around the patient;

a detachable bladder, detachably attached to the belt, said bladder having a width, said bladder comprising:

a bottom-chest panel composed of an inextensible material that is adapted to cover at least substantially the entire portion of the top of the chest of the patient;

a top-belt panel composed of an inextensible material and sealed to said bottom-chest panel to form a gas tight bladder chamber having an opening to receive compressed gas;

wherein the bottom-chest panel and the top-belt panel form a radially extensible bellows.

7. The vest of claim 6, wherein the bottom-chest panel and the top-belt panel are made of nylon fabric double coated with polyurethane.

8. The vest of claim 6, wherein the width of said bladder is at least two inches greater than the width of the belt.

9. An inflatable vest for administering CPR to a patient, the patient having a chest, said chest having an anterior surface extending laterally between the patient's armpits and superiorly along the superior-inferior length of the patient's sternum, said inflatable vest comprising:

a belt sized to circumferentially fit around the patient's chest and to cover substantially the entire anterior surface of the chest, said belt being substantially circumferentially inextensible when fitted around the patient; and a bladder attached to the belt so that, when the belt is fitted around the patient's chest, the bladder is disposed between the belt and the patient's chest, said bladder having a width and said bladder comprising:

a bottom panel composed of an inextensible material that is adapted to cover substantially the entire anterior surface of the chest of the patient;

a top panel composed of an inextensible material and sealed to the bottom and to form the bladder;

wherein the width of said bladder is at least two inches greater than the width of the belt.

10. An inflatable vest for administering CPR to a patient, the patient having a chest, said chest having an anterior surface extending laterally between the patient's armpits and superiorly along the superior-inferior length of the patient's sternum, said inflatable vest comprising:

a belt sized to circumferentially fit around the patient's chest and to cover substantially the entire anterior surface of the chest, said belt being substantially circumferentially inextensible when fitted around the patient; and a bladder attached to the belt so that, when the belt is fitted around the patient's chest, the bladder is disposed between the belt and the patient's chest, said bladder having a width and said bladder comprising:

a bottom panel composed of an inextensible material that is adapted to cover substantially the entire anterior surface of the chest of the patient;

a top panel composed of an inextensible material and sealed to the bottom panel to form the bladder;

wherein the bladder further comprises an opening to receive compressed gas;

wherein the bottom panel and the top panel form a radially extensible bellows;

wherein the width of said bladder is at least two inches greater than the width of the belt.

* * * * *